US007537516B2

(12) United States Patent
Jenrick

(10) Patent No.: US 7,537,516 B2
(45) Date of Patent: May 26, 2009

(54) COIN RECEPTACLE APPARATUS AND METHOD

(75) Inventor: Paul W. Jenrick, Schaumburg, IL (US)

(73) Assignee: SPX Corporation, Charlotte, NC (US)

( * ) Notice: Subject to any disclaimer, the term of this patent is extended or adjusted under 35 U.S.C. 154(b) by 136 days.

(21) Appl. No.: 11/266,184

(22) Filed: Nov. 4, 2005

(65) Prior Publication Data

US 2006/0102445 A1 May 18, 2006

Related U.S. Application Data

(60) Provisional application No. 60/625,170, filed on Nov. 5, 2004.

(51) Int. Cl.
*G07D 1/00* (2006.01)
*G07F 1/02* (2006.01)

(52) U.S. Cl. ..... 453/18; 194/351; 206/0.815

(58) Field of Classification Search ..... 453/3, 453/9, 14, 18, 63; 194/351; 193/DIG. 1, 193/2 E; 232/4 R, 9, 55; 206/0.8, 0.815, 206/445

See application file for complete search history.

(56) References Cited

U.S. PATENT DOCUMENTS 537,069 A * 4/1895 Reynolds ..... 453/14
864,938 A * 9/1907 Tinsley ..... 206/0.8
4,023,728 A * 5/1977 Gamberg ..... 232/4 R
4,947,995 A * 8/1990 Eguchi ..... 211/49.1
5,697,611 A * 12/1997 Kelly et al. ..... 273/126 A

* cited by examiner

*Primary Examiner*—Patrick Mackey
*Assistant Examiner*—Mark Beauchaine
(74) *Attorney, Agent, or Firm*—Baker & Hostetler LLP

(57) ABSTRACT

A coin receptacle includes a cup, a slot within the cup, a channel within the cup having one or more sides to direct coins placed in the cup into the slot, and one or more ledges located on the one or more sides of the channel. A method for providing singularized coins into a slot including depositing coins into a cup, directing the coins toward a channel within the cup, singularizing the coins at the channel, and providing singularized coins from the channel to a slot located within the cup.

18 Claims, 6 Drawing Sheets

COIN RECEPTACLE APPARATUS AND METHOD

CROSS-REFERENCE TO RELATED APPLICATIONS

This application claims priority to provisional U.S. patent application entitled, Coin Separating Apparatus and Method, filed Nov. 5, 2004, having a Ser. No. 60/625,170, the disclosure of which is hereby incorporated by reference in its entirety.

FIELD OF THE INVENTION

The present invention relates generally to a coin receptacle apparatus and method. More particularly, the present invention relates to a coin receptacle apparatus and method for use with a coin counting and sorting machine.

BACKGROUND OF THE INVENTION

Public transportation vehicles, such as buses, require a convenient and reliable way for passengers to pay their fare with tokens or coins. Coins with reeded edges—such as the U.S. dime, quarter, half dollar, and some dollar coins—can wedge with other coins when multiple coins are dropped at the same time into a coin receptacle.

In some present coin receptacles, it is often difficult to loosen coins wedged together in coin receptacles. At the very least, it takes time for a public transportation patron to clear the jammed coins. A severe jam, however, could require the assistance of a public transportation system employee to clear the jam. If the coin receptacle is located on a bus, the likely public transportation system employee to clear the jam would be the bus driver. Clearing the jammed coins would take the bus driver's attention away from other duties. Thus, a jammed coin receptacle potentially could result in delays.

Even in the best circumstance, when coins repeatedly jam in a coin receptacle and can be loosened by the public transportation patron, the average time it takes for a passenger to board the bus increases. Generally, as the average time necessary for a passenger to board a bus increases, the transportation authority must increase the time between scheduled stops to allow for all passengers to board the bus. This unnecessary waste of time needed to board a bus means either that people will have to wait longer at a bus stop for a bus than necessary, or that the transportation authority will have to put additional buses into service on each route in order to reduce the wait for a bus.

The average number of passengers that use a bus on any given day is monitored by the transportation authority. By determining both the average number of passengers that frequent a particular bus line, and the average time for a passenger to board a bus, the transportation authority can create an accurate bus schedule. Any decrease in the average time for a passenger to board the bus would reduce the time needed for a bus to wait at any one stop. In addition, a substantial reduction in the average time needed to board a bus could result in a decrease in the number of busses needed on a route because busses could make a complete circuit faster than before. These unneeded busses could then be placed on other routes that may be presently underserved.

During other high volume times at a particular stop—such as after a sporting event—the extra time needed for each passenger to board the bus could result in substantial departure delays. When a large number of people wish to board the bus at one particular stop, this departure delay could cause the bus to fall behind a schedule that did not take into account the increased volume of passengers.

Waiting for a bus for an extended period of time in inclement weather is inconvenient to the public transportation patron, and purchasing additional vehicles in order to maintain a standard of service is costly for the transportation authority. It would simply be easier to reduce the average amount of time necessary for a person to board a public transportation vehicle.

Accordingly, it is desirable to provide an apparatus and method that helps reduces coin jams and also provides for easy clearing of the coin receptacle in the event that coins do jam in it in order to decrease the average amount of time necessary for a person to board a public transportation vehicle.

SUMMARY OF THE INVENTION

The forgoing needs are met, to a great extent, by the present invention, wherein in one aspect it is provided that some embodiments help reduce coin jams and also provide for easy clearing of the coin receptacle in the event that coins do jam in it in order to decrease the average amount of time necessary for a person to board a public transportation vehicle.

In accordance with one embodiment of the present invention a coin receptacle includes a cup, a slot within the cup, a channel within the cup having one or more sides to direct coins placed in the cup into the slot, and one or more ledges located on the one or more sides of the channel. In some embodiments, the coin receptacle further includes one or more substantially angled surfaces proximate to said slot, wherein said one or more ledges meet said one or more substantially angled surfaces at an angle. In some other embodiments, the one or more ledges meet said one or more substantially angled surfaces at a right angle.

In yet other embodiments, the coin receptacle further includes a shelf within the cup adjacent to the slot, wherein the shelf is positioned adjacent to the one of the sides of the channel. In some other embodiments, the width of the slot is sized such that only one coin of a largest width may pass through it at one time. In yet other embodiments, the width of the channel is determined by the width of the slot. In yet other embodiments, the one or more ledges are staggered on the one or more sides of the channel such that the one or more ledges are not directly opposite each other on facing one or more sides of the channel. In still other embodiments, the one or more ledges have a width sized up to seventy-five percent of the width of a narrowest coin. In yet other embodiments, the cup comprises one or more sides constructed and arranged to direct one or more coins toward the slot.

In yet other embodiments, the shelf is located no more than the radius of a smallest coin from a top of the cup. In yet other embodiments, the distance between the one or more ledges located on the same one or more side of the channel is equal to two times the height of a ridge of a coin with tallest ridge. In still other embodiments, the one or more ledges have a width sized according to the width of a narrowest coin. In yet other embodiments, the channel is centered over the slot having a width identical to the slot. In yet other embodiments, the coin receptacle further comprises three ledges, each ledge having a width equal to seventy-five percent of the width of a United States dime, and the ledges are indented into the one or more sides of the channel, such that the narrowest part of the channel is equal to the width of the slot. In yet other embodiments, the one or more ledges are constructed and arranged to direct a coin toward the slot.

In accordance with another embodiment of the present invention, a coin receptacle includes means for receiving coins, means for passing coins through the means for receiving coins, means for directing coins that are placed in the means for receiving coins to the means for passing coins through the means for receiving coins, and means for delaying coins placed in the means for receiving coins from moving toward the means for passing coins through the means for receiving coins. In some embodiments, the coin receptacle further comprises means for allowing a human finger access to the means for receiving coins. In some other embodiments, the means for delaying coins further comprises means for holding coins above the means for passing coins. In yet other embodiments, the means for delaying coins is constructed and arranged to hold coins long enough for the means for passing coins to pass any coins already located within the means for passing coins. In yet other embodiments, the means for passing coins is located within the means for directing coins, and the means for delaying coins is integral to the means for directing coins.

In accordance with yet another embodiment of the present invention, a method for providing singularized coins into a slot comprising depositing coins into a cup, directing the coins toward a channel within the cup, singularizing the coins at the channel, providing singularized coins from the channel to a slot located within the cup. In some other embodiments, the method further comprises holding the coins within the channel until a previous coin passes through the slot. In yet other embodiments, the method further comprises providing an access point for a human finger to dislodge coins jammed in the slot. In yet other embodiments, the coins are directed toward the channel by one or more walls of the cup, wherein the one or more walls of the cup are tapered toward the channel. In yet other embodiments, coins are held away from the slot along the channel wall until the slot is clear of singularized coins.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
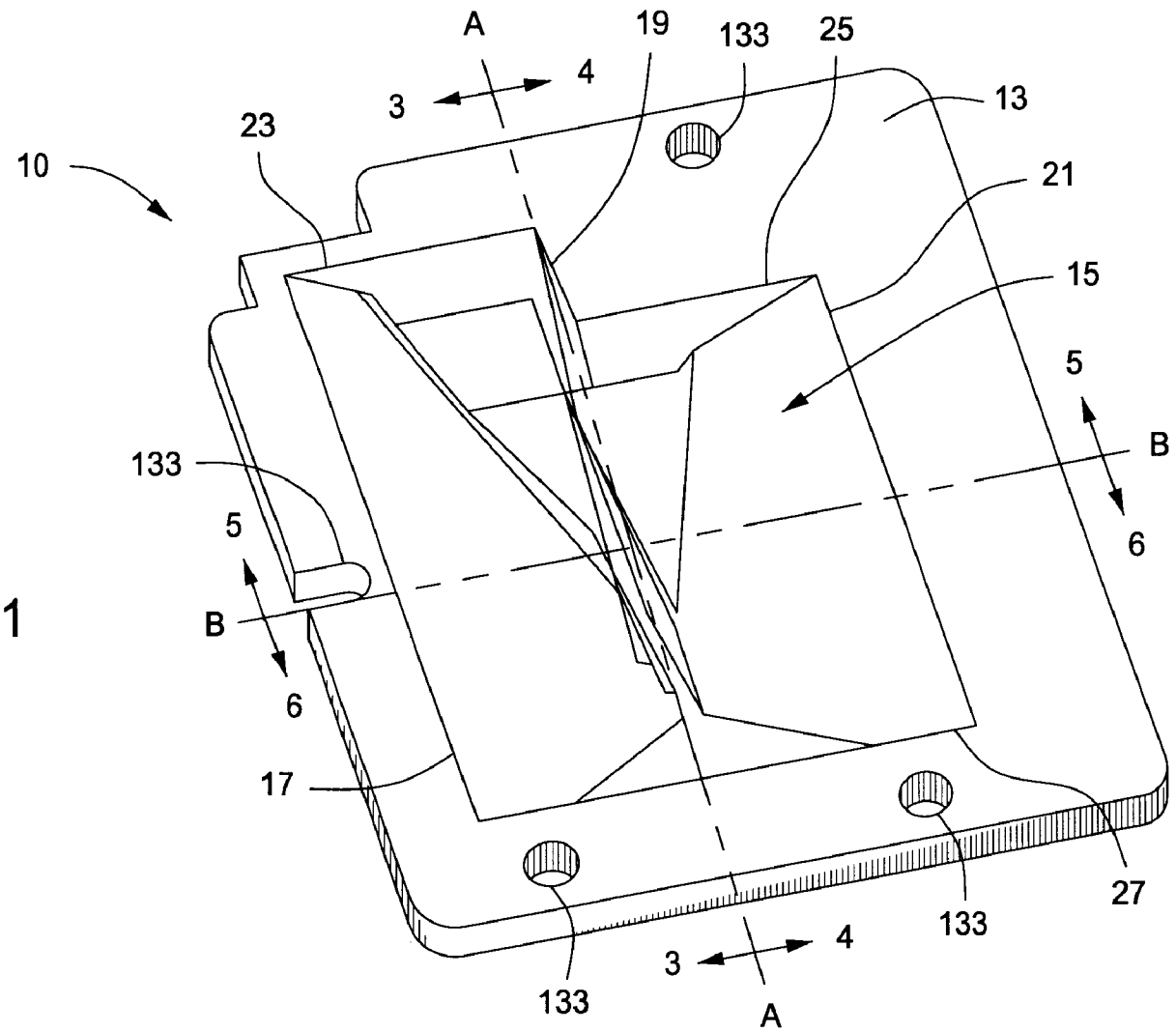
FIG. 1 is a perspective view illustrating a coin receptacle according to a preferred embodiment of the invention.

The invention will now be described with reference to the drawing figures, in which like reference numerals refer to like parts throughout. An embodiment in accordance with the present invention provides a coin receptacle as shown and described that helps prevent or reduce coin jams, and also provides easy clearing of jammed coins if the coin receptacle does jam. The coin receptacle has a coin slot, a coin channel designed to direct coins to the coin slot, walls designed to direct coins to the coin channel until coins closer to the slot pass through the slot, and a ledge for allowing a human finger to easily clear coins that jam in the slot or the channel. The coin slot leads to a coin counting and sorting mechanism. The walls of the channel include ledges that are constructed and arranged to hold coins away from the slot in order to allow one coin at a time (i.e. a singluated coin) to pass from the channel into the slot.

An embodiment of the present inventive apparatus is illustrated in FIGS. 1-6. FIG. 1 depicts a coin receptacle 10 comprising a hole 15 in a substantially planar structure 13. The substantially planar structure 13 includes attachment portions 133 used for securing the coin receptacle to a change counting machine (not shown). The hole 15 has a generally rectangular shape. The hole 15 has a first hole side 17, a second hole side 19, and a third hole side 21 all oriented in a substantially parallel direction to each other. The hole 15 has a fourth hole side 23, a fifth hole side 25, and a sixth hole side 27 all oriented substantially parallel to each other and substantially perpendicular to the first hole side 17, the second hole side 19, and third hole side 21.

Figure 2:
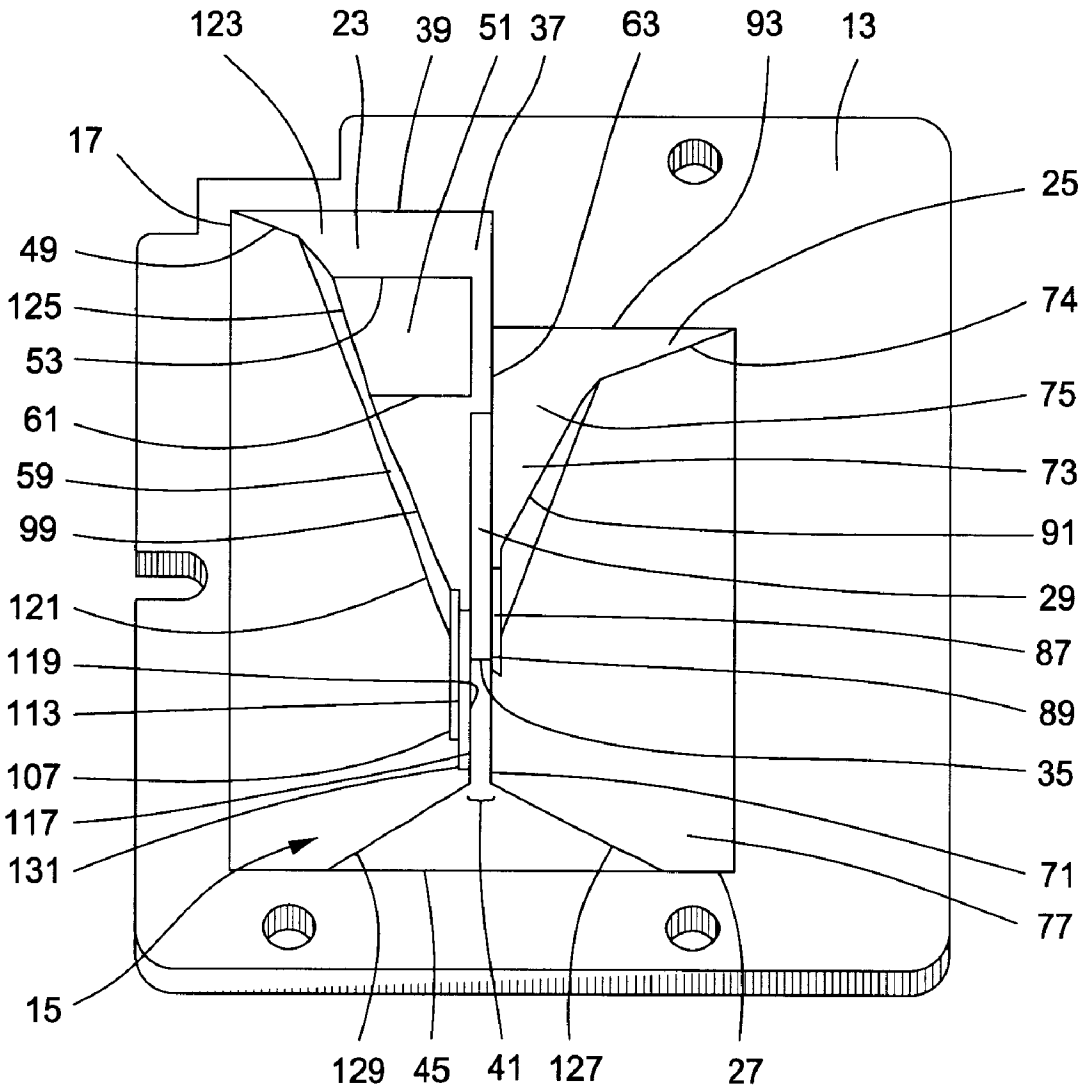
FIG. 2 is another perspective view illustrating a coin receptacle according to a preferred embodiment of the invention.

FIG. 2 depicts a slot 29 of a generally rectangular shape located within the hole 15 and below the substantially planar structure 13. The slot 29 is sized such that only one of the largest coins may pass through it at one time, for example, in a typical application with U.S. coinage, the largest coin in a coin set may be a quarter-dollar coin, a half-dollar coin, or a dollar coin depending on the coins contemplated to be used. United States coinage is described as exemplary only. Other embodiments in accordance with the invention may use coinage of other countries or even tokens.

FIG. 2 also depicts the slot 29 having a first slot side 31 (see FIG. 3) and a second slot side 33 (see FIG. 4) that are oriented substantially parallel to each other. The slot 29 has a third slot side 35 and a fourth slot side 37 that are oriented substantially parallel to each other and substantially perpendicular to the first slot side 31 (see FIG. 3) and the second slot side 33 (see FIG. 4). In one embodiment of the invention, the slot 29 is centered within the hole 15 along the sixth hole side 27, and the slot 29 is off-center within the hole 15 with respect to the first hole side 17, with the fourth slot side 37 being flush with a first substantially perpendicular surface 39.

FIG. 2 also depicts a channel 41 centered within the hole 15 with respect to the sixth hole side 27. According to some embodiments of the invention, the width of the channel 41 is determined by a largest coin to be accepted by the slot 29.

Coins centered on the channel 41 will be passed to the slot 29. Coins that pass through the slot 29 will enter the coin counting and sorting device (not shown). The channel 41 is defined by the first substantially perpendicular surface 39, a second substantially perpendicular surface 43 (see FIG. 4), a first substantially angled surface 45, and a third substantially perpendicular surface 47 (see FIG. 3). The second substantially perpendicular surface 43 (see FIG. 4) is substantially parallel to the first hole side 17 and extends below the substantially planar structure 13 to form the second slot side 33 (see FIG. 4). The third substantially perpendicular surface 47 (see FIG. 3) is substantially parallel to the first hole side 17 and extends below the substantially planar structure 13 to form the first slot side 31 (see FIG. 3). The first substantially angled surface 45 extends from the sixth hole side 27 to the third slot side 35. The first substantially perpendicular surface 39 extends from the fourth hole side 23 below the substantially planar structure 13 to the fourth slot side 37.

Figure 3:
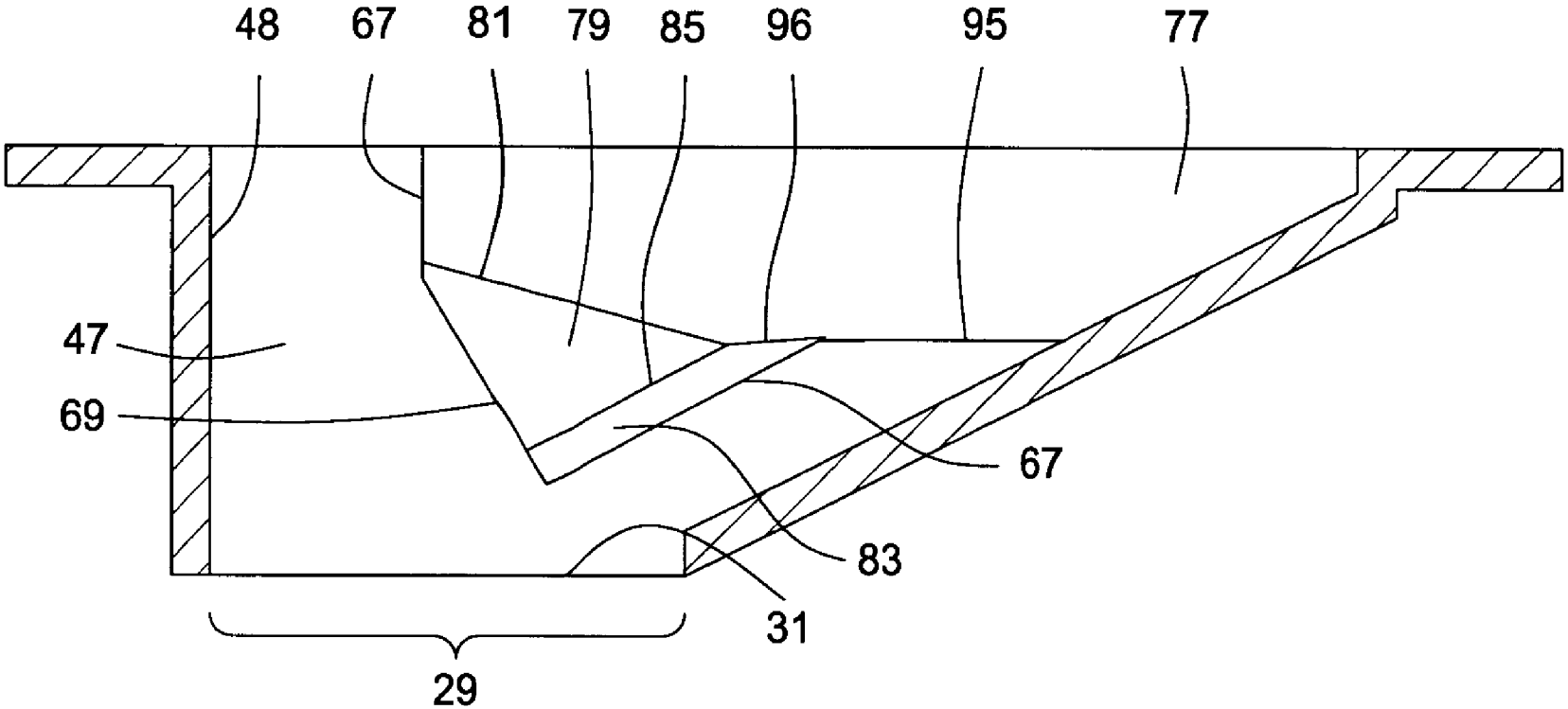
FIG. 3 is a cross-sectional view taken along line A in FIG. 1.

FIG. 2 also depicts the first substantially perpendicular surface 39 extending from a first edge 49 to the right to meet at a substantially right angle the third substantially perpendicular surface 47 (see FIG. 3) in an edge 48 (see FIG. 3). The first substantially perpendicular surface 39 extends from the fourth hole side 23 below the substantially planar structure 13 and meets a first ledge 51 at a second edge 53, and the first substantially perpendicular surface 39 meets at a substantially right angle the second substantially perpendicular surface 43 (see FIG. 4) at a third edge 55 (see FIG. 4). The first ledge 51 allows a human finger access toward the channel 41 and the slot 29 to allow coins that jam in the channel 41 or the slot 29 to be cleared easily.

FIG. 2 also depicts the first ledge 51 substantially parallel to the substantially planar structure 13 and located a distance below the substantially planar structure 13 of no more than the radius of a smallest coin to be accepted by the slot 29. The second substantially perpendicular surface 43 (see FIG. 4) meets the first ledge 51 at a fourth edge 57 (see FIG. 4).

FIG. 2 also depicts a second substantially angled surface 59 extending from a fifth edge 61 at an angle from the first ledge 51. The second substantially angled surface 59 meets the second substantially perpendicular surface 43 (see FIG. 4) in an edge 60 (see FIG. 4).

FIG. 3 depicts the third substantially perpendicular surface 47 meeting at a substantially perpendicular angle with the substantially planar structure 13 (see FIG. 1) at the second hole side 19 (see FIG. 1). The third substantially perpendicular surface 47 extends so as to become the first slot side 31.

Returning to FIG. 2, the third substantially perpendicular surface 47 (see FIG. 3) extends from the first substantially perpendicular surface 39 to the right to meet with a fourth substantially perpendicular surface 63 at a sixth edge 67 (see FIG. 3); to meet with the third substantially angled surface 73 at a seventh edge 69 (see FIG. 3); to meet with the first substantially angled surface 45 at a eighth edge 71; and to meet with the fourth substantially angled surface 77 at a fifteenth edge 95 (see FIG. 3).

FIG. 2 also depicts the fourth substantially perpendicular surface 63 meeting the substantially planar structure 13 at the fifth hole side 25 at a substantially perpendicular angle, and extends below the substantially planar structure 13 to meet the third substantially angled surface 73 at a ninth edge 75 substantially parallel to the fifth hole side 25, the ninth edge 75 being a continuation of the fifth edge 61 formed by the meeting of the first ledge 51 and the second substantially angled surface 59. The fourth substantially perpendicular surface 63 meets the fourth substantially angled surface 77 at an edge 74.

Returning to FIG. 3, the fourth substantially angled surface 77 extends from the third hole side 21 (see FIG. 1) and meets a fifth substantially angled surface 79. The fourth substantially angled surface 77 and the fifth substantially angled surface 79 meet at a tenth edge 81. In one embodiment, the fifth substantially angled surface 79 is angled more steeply than the fourth substantially angled surface 77.

FIG. 3 depicts the fifth substantially angled surface 79 extending from the tenth edge 81 to meet a fifth substantially perpendicular surface 83 at an eleventh edge 85. The fifth substantially perpendicular surface 83 extends from the eleventh edge 85 to meet a second ledge 87 (see FIG. 2) at the sixth edge 67. The fourth substantially angled surface 77 meets the fifth substantially perpendicular surface 83 at an edge 96.

Returning to FIG. 2, the second ledge 87 meets the third substantially angled surface 73. The width of the second ledge 87 is determined by the width of the largest coin to be accepted by the slot 29, such as a one dollar coin in U.S. coinage. The second ledge 87 is constructed and arranged to hold coins in the channel 41 and away from the slot 29 until other coins have passed through the slot 29, while at the same time directing the same coins toward the third substantially angled surface 73. The second ledge 87 is substantially parallel to the substantially planar structure 13 in a direction substantially parallel to the sixth hole side 27 and angles toward the third substantially angled surface 73 in a direction substantially parallel to the first hole side 17, substantially parallel to the eleventh edge 85. The second ledge 87 meets at a substantially right angle the third substantially perpendicular surface 47 (see FIG. 3) at a twelfth edge 89. The fifth substantially angled surface 79 (see FIG. 3) meets the third substantially angled surface 73 in a thirteenth edge 91. The fifth substantially angled surface 79 (see FIG. 3) meets the fourth substantially perpendicular surface 63 in a fourteenth edge 93.

Figure 4:
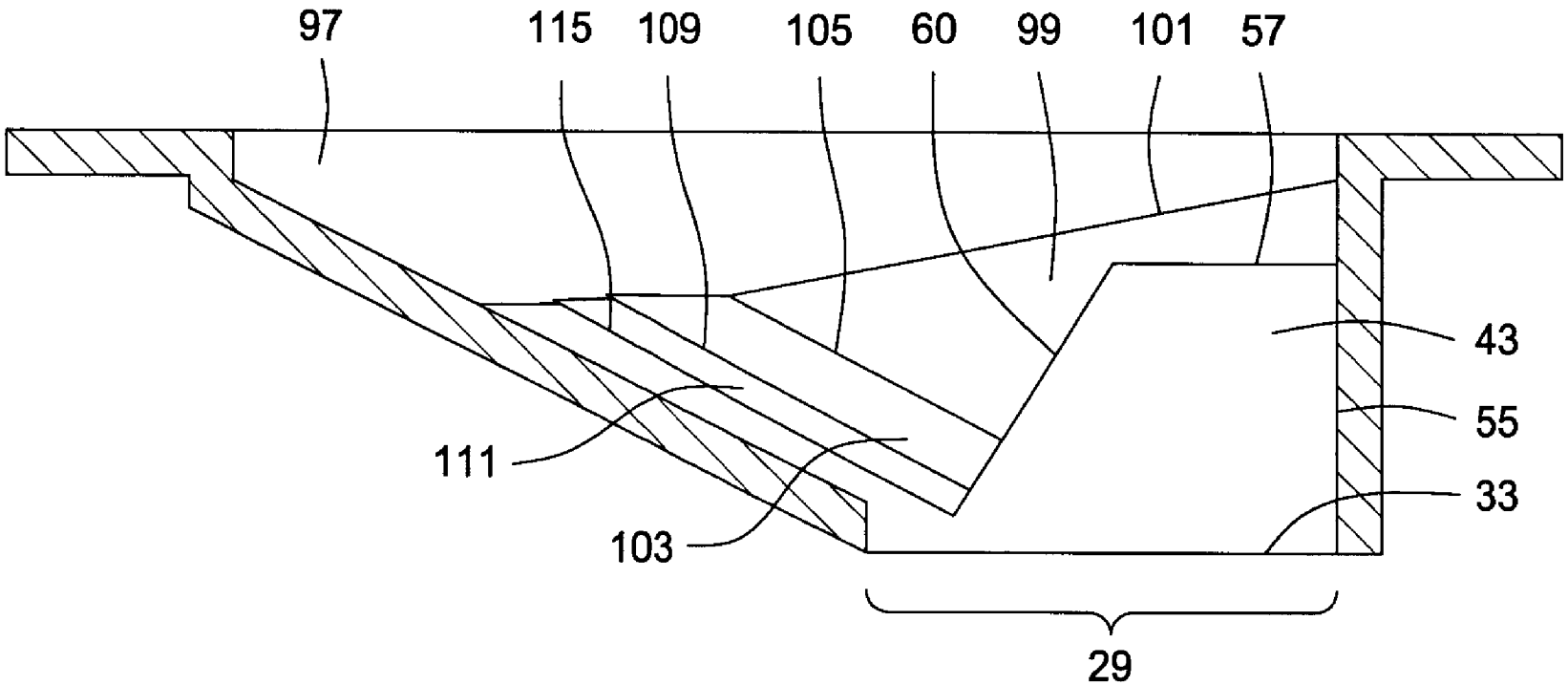
FIG. 4 is a cross-sectional view taken along line A in FIG. 1.
Figure 5:
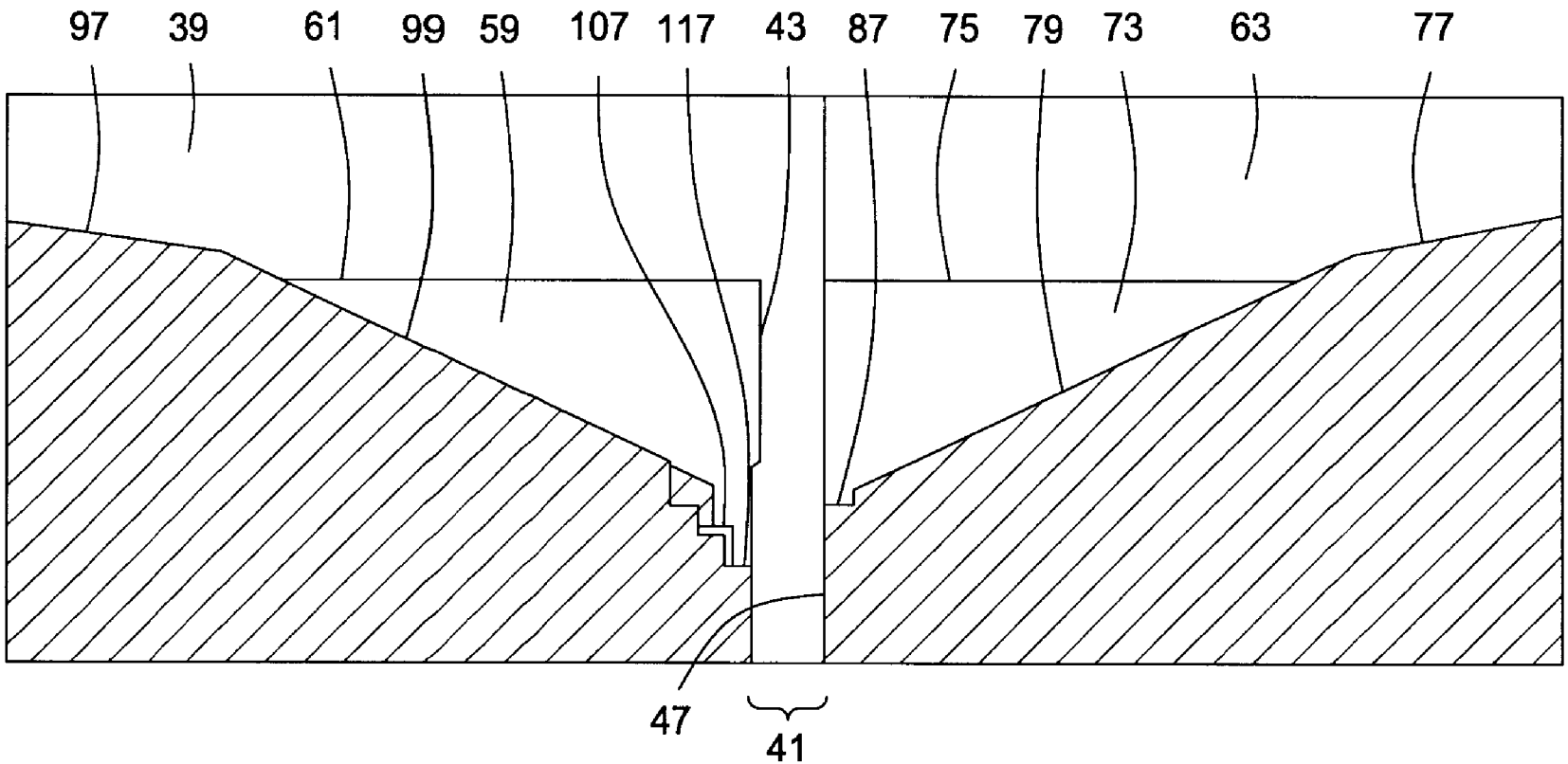
FIG. 5 is a cross-sectional view taken along line B in FIG. 1.
Figure 6:
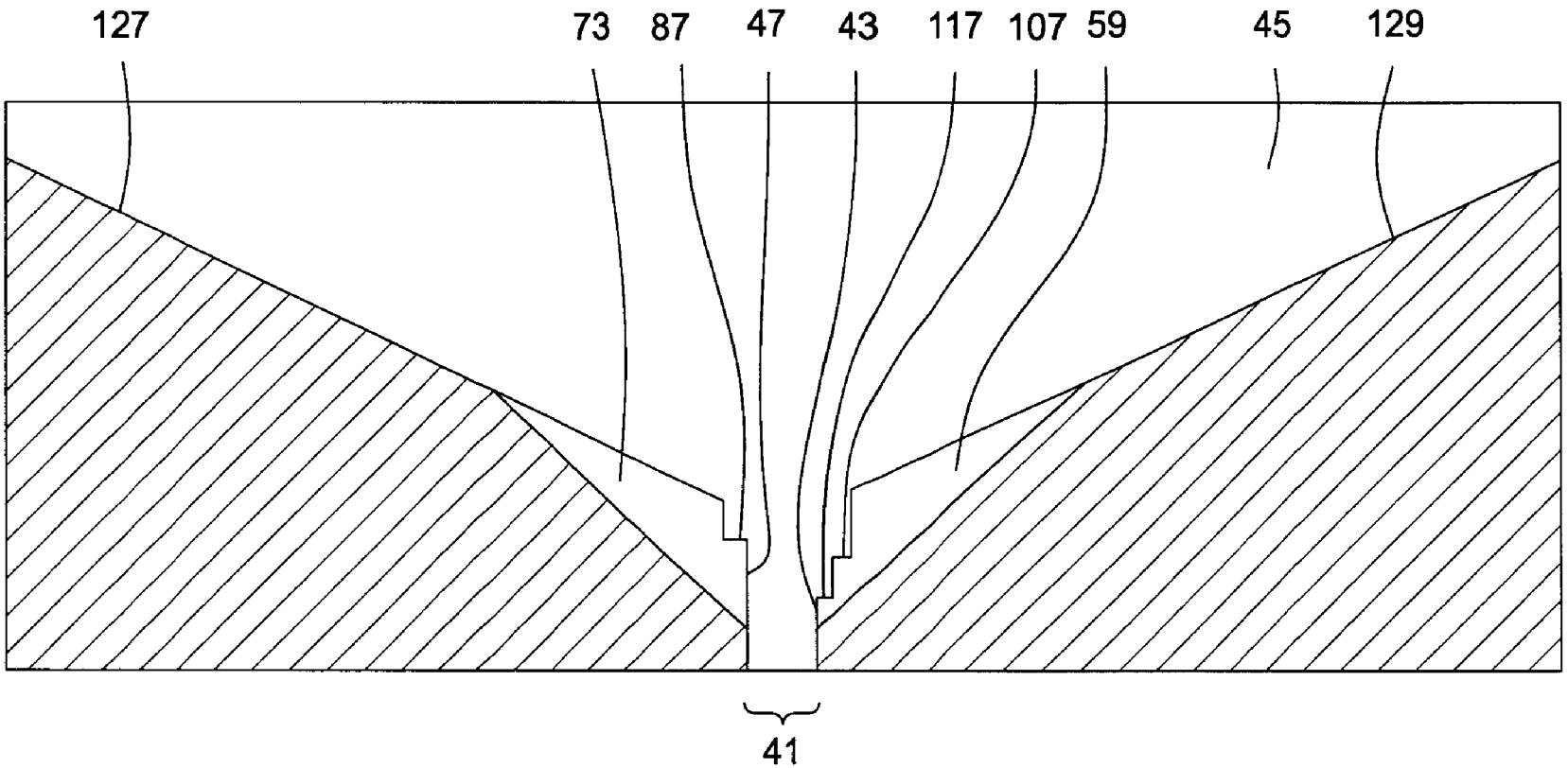
FIG. 6 is a cross-sectional view taken along line B in FIG. 1.

FIG. 4 depicts a seventh substantially angled surface 97 extending from the first hole side 17 (see FIG. 1) to meet a sixth substantially angled surface 99 at a sixteenth edge 101. The sixth substantially angled surface 99 extends from the sixteenth edge 101 to meet a sixth substantially perpendicular surface 103 at a seventeenth edge 105. The sixth substantially perpendicular surface 103 extends from the seventeenth edge 105 to meet a third ledge 107 (see FIG. 2) at an eighteenth edge 109.

Returning to FIG. 2, the third ledge 107 meets in a substantially right angle the second substantially angled surface 59. The third ledge 107 is substantially parallel to the substantially planar structure 13 in the sixth hole side 27 and angles toward the second substantially angled surface 59 in a direction parallel to the first hole side 17, substantially parallel to the seventeenth edge 105 (see FIG. 4). The third ledge 107 is constructed and arranged to hold coins in the channel 41 and away from the slot 29 until other coins have passed through the slot 29, while at the same time directing the same coins toward the second substantially angled surface 59.

FIG. 2 also depicts the third ledge 107 and a seventh substantially perpendicular surface 111 (see FIG. 4) meeting at a twentieth edge 113. The seventh substantially perpendicular surface 111 (see FIG.4) extends from the twentieth edge 113 to meet a fourth ledge 117 at a twenty-first edge 115 (see FIG. 4). The fourth ledge 117 meets in a substantially right angle the second substantially angled surface 59. The fourth ledge 117 is substantially parallel to the substantially planar structure 13 in the sixth hole side 27 and angles toward the second substantially angled surface 59 in a direction substantially parallel to the first hole side 17 substantially parallel to the seventeenth edge 105 (see FIG. 4). The fourth ledge 117 meets the second substantially angled surface 59 to form a substantially right angle. The fourth ledge 117 meets the second substantially perpendicular surface 43 (see FIG. 4) at a twenty-second edge 119. The second substantially perpendicular surface 43 (see FIG. 4) extends below the substantially planar structure 13 to meet with the first-substantially angled surface in a twenty-eighth edge 131. The fourth ledge 117 is constructed and arranged to hold coins in the channel 41 and away from the slot 29 until other coins have passed through the slot 29, while at the same time directing the same coins toward the second substantially angled surface 59.

FIG. 2 also depicts the sixth substantially angled surface 99 meeting the second substantially angled surface 59 at a twenty-third edge 121. The sixth substantially angled surface 99 meets the first substantially perpendicular surface 39 at a twenty-fourth edge 123. The sixth substantially angled surface 99 meets the first ledge 51 at a twenty-fifth edge 125. The seventh substantially angled surface 97 meets the first substantially perpendicular surface 39 at the first edge 49.

FIG. 2 also depicts the first substantially angled surface 45 meeting the fourth substantially angled surface 77 at a twenty-sixth edge 127. The first substantially angled surface 45 meets a seventh substantially angled surface 97 (see FIG. 4) at a twenty-seventh edge 129. The second substantially perpendicular surface 43 (see FIG. 4) meets the first substantially angled surface 45 at a twenty-eighth edge 131. The third substantially perpendicular surface 47 (see FIG. 3) meets the first substantially angled surface 45 at the eighth edge 71.

FIG. 2 also shows one embodiment of the invention where the ledge 87 is angled toward the third substantially angled surface 73 so that the ledge 87 and the third substantially angled surface meet at a right angle. Simiarly, the ledges 107 and 117 are angled toward the second substantially angled surface 59 so that the ledges 107 and 117 and the second substantially angled surface 59 meet at a right angle. The ledge 87 and the third substantially angled surface 73, and ledges 107 and 117 and the second substantially angled surface 59 hold coins dropped in the hole 15 in place along the channel 41 without wedging multiple coins together. This allows a coin alligned with the slot 29 to pass through the slot unimpeded by other coins placed in the hole.

In another embodiment of the invention, the total number of ledges (see, e.g., ledges 87, 107, and 117 in FIG. 2) placed on the channel walls (see, e.g., the second substantially perpendicular surface 43 in FIG. 4, and the third substantially perpendicular surface 47 in FIG. 3) is determined by the number of different sized coins to be accepted by the coin slot. In a coin receptacle according to the present invention designed to accept U.S. nickels, dimes, and quarters, there would be a total of three ledges (see, e.g., ledges 87, 107, and 117 in FIG. 2) on the channel walls (see, e.g., the second substantially perpendicular surface 43 in FIG. 4, and the third substantially perpendicular surface 47 in FIG. 3) corresponding to the three different sizes of coins. In another embodiment of the present invention, the width of the ledges on the channel walls are about seventy-five percent of the width of the narrowest coin to be accepted by the slot. The ledges are placed on the opposing channel walls so that they are staggered.

In another embodiment of the present invention, the substantially angled surfaces (see, e.g., 45, 59, and 73 in FIG. 2, 77 and 79 in FIG. 3, and 97 and 99 in FIG. 4) are flat faced and angled toward the channel. In another embodiment, however, the substantially angled surfaces can be curved for rounded so long as they are formed to allow the coins placed in the cup to be drawn by gravity toward the channel and ultimately into the slot.

In yet another embodiment of the present invention, the spacing between each of the ledges (see, e.g., ledges 87, 107, and 117 in FIG. 2) on one channel wall (see, e.g., the second substantially perpendicular surface 43 in FIG. 4, or the third substantially perpendicular surface 47 in FIG. 3) is equal to twice the width of the ridge (i.e. the width of the slightly raised boarder around edge of the face of a coin) of the coin in the coin set being used that has the tallest ridge. In the case of U.S. coinage, the Sacagawea dollar coin currently has the widest ridge.

The many features and advantages of the invention are apparent from the detailed specification, and thus, it is intended by the appended claims to cover all such features and advantages of the invention which fall within the true spirit and scope of the invention. Further, because numerous modifications and variations will readily occur to those skilled in the art, it is not desired to limit the invention to the exact construction and operation illustrated and described, and accordingly, all suitable modifications and equivalents may be resorted to, falling within the scope of the invention.

I claim:

1. A coin receptacle comprising:

a cup;

a slot within said cup;

a channel within said cup having one or more sides to direct coins placed in the cup into said slot; and a plurality of intersecting ledges located proximate to the one or more sides of said channel, wherein said plurality of intersecting ledges are staggered on the one or more sides of said channel such that said plurality of intersecting ledges are not directly opposite each other.

2. The coin receptacle of claim 1, further comprising a plurality of planar surfaces within said cup adjacent to said slot, wherein the at least one of a plurality of planar surfaces is positioned adjacent to the one of the sides of said channel.

3. The coin receptacle of claim 1, further comprising one or more substantially angled planar surfaces proximate to said slot, wherein said plurality of intersecting ledges meet said one or more substantially angled planar surfaces at an angle.

4. The coin receptacle of claim 3, wherein said plurality of intersecting ledges meet said one or more substantially angled planar surfaces at substantially a right angle.

5. The coin receptacle of claim 1, wherein a width of said slot is sized such that only one coin of a first predetermined size width may pass through it at one time.

6. The coin receptacle of claim 5, wherein a width of the channel is also determined by said only one coin of the first predetermined size.

7. The coin receptacle of claim 2, wherein said plurality of intersecting ledges have a width sized up to seventy-five percent of a width of the narrowest coin.

8. The coin receptacle of claim 1, wherein said cup comprises one or more sides constructed and arranged to direct one or more coins toward said slot.

9. The coin receptacle of claim 1, wherein said planar surface is located no more than a radius of a predetermined second size coin from a top of said cup.

10. The coin receptacle of claim 2, wherein a distance between said plurality of intersecting ledges located on the same one or more side of said channel is equal to two times the height of a ridge of at least a tallest coin.

11. The coin receptacle of claim 1, wherein said plurality of intersecting ledges have a width sized according to a width of a narrowest coin.

12. The coin receptacle of claim 1, wherein said channel is centered over said slot having a width identical to said slot.

13. The coin receptacle of claim 1, wherein said plurality of intersecting ledges are constructed and arranged to direct the coin toward said slot.

14. A coin receptacle comprising:

means for receiving coins;

means for passing coins through the means for receiving coins;

means for directing coins that are placed in said means for receiving coins to said means for passing coins through the means for receiving coins; and means for delaying coins placed in said means for receiving coins, wherein said means for delaying coins includes plurality of staggered intersecting ledges on one or more sides such that said plurality of staggered intersecting ledges are not directly opposite each other.

15. The coin receptacle of claim 14, further comprising a means for allowing a human finger access to the means for receiving coins.

16. The coin receptacle of claim 14, further comprising a means for holding coins above said means for passing coins.

17. The coin receptacle of claim 14, wherein said means for delaying coins is constructed and arranged to hold coins long enough for the means for passing coins to pass any coins already located within the means for passing coins.

18. A coin receptacle comprising:

a cup;

a slot within said cup;

a channel centered over said slot having a width identical to said slot within said cup having one or more sides to direct coins placed in the cup into said slot; and three intersecting ledges located proximate to the one or more sides of said channel, wherein said three intersecting ledges having a width equal to seventy-five percent of a width of approximately 0.053 inches; and wherein the intersecting ledges are indented into the one or more sides of said channel, such that the narrowest part of the channel is equal to the width of said slot.

* * * * *

UNITED STATES PATENT AND TRADEMARK OFFICE

CERTIFICATE OF CORRECTION

PATENT NO. : 7,537,516 B2
APPLICATION NO. : 11/266184
DATED : May 26, 2009
INVENTOR(S) : Paul W. Jenrick It is certified that error appears in the above-identified patent and that said Letters Patent is hereby corrected as shown below:

Column 8, line 48
Please remove "width".

Signed and Sealed this

Seventh Day of July, 2009

JOHN DOLL
*Acting Director of the United States Patent and Trademark Office*